US006857232B2

(12) United States Patent
Bealko

(10) Patent No.: US 6,857,232 B2
(45) Date of Patent: Feb. 22, 2005

(54) WINDOW AND DOOR CASING

(75) Inventor: Donald J. Bealko, Bedford, NH (US)

(73) Assignee: Riverside Millwork Co., Inc., Penacook, NH (US)

( * ) Notice: Subject to any disclaimer, the term of this patent is extended or adjusted under 35 U.S.C. 154(b) by 0 days.

(21) Appl. No.: 10/287,962

(22) Filed: Nov. 5, 2002

(65) Prior Publication Data

US 2003/0056450 A1 Mar. 27, 2003

Related U.S. Application Data

(62) Division of application No. 09/575,340, filed on May 19, 2000, now abandoned.

(51) Int. Cl.[7] ..... E06B 1/04
(52) U.S. Cl. ..... 52/211; 52/656.5
(58) Field of Search ..... 52/204.5, 204.53, 52/204.54, 204.55, 656.4, 656.5, 656.2, 656.3, 656.6, 717.01, 734.1

(56) References Cited

U.S. PATENT DOCUMENTS

| | | | | | |
|---|---|---|---|---|---|
| 3,220,062 | A | * | 11/1965 | Hermann | 52/211 |
| 4,193,238 | A | | 3/1980 | Chalmers et al. | 52/211 |
| 4,280,309 | A | * | 7/1981 | Huelsekopf | 52/204.54 |
| 4,389,824 | A | | 6/1983 | Anderson | 52/211 |
| 4,407,100 | A | * | 10/1983 | Huelsekopf | 52/204.54 |
| 4,428,156 | A | | 1/1984 | Malm et al. | 49/501 |
| 4,457,110 | A | | 7/1984 | Beirnes | 49/419 |
| 4,516,356 | A | | 5/1985 | Delman | 49/504 |
| 4,563,846 | A | | 1/1986 | Webb | 52/208 |
| 4,624,091 | A | | 11/1986 | Biro | 52/656 |
| 4,747,248 | A | | 5/1988 | Fahs | 52/455 |
| 4,831,804 | A | | 5/1989 | Sayer | 52/475 |
| 4,972,640 | A | | 11/1990 | DiFazio | 52/211 |
| 5,022,204 | A | | 6/1991 | Anderson | 52/211 |
| 5,222,343 | A | | 6/1993 | Anderson | 52/718.04 |
| 5,257,488 | A | * | 11/1993 | Candusso | 52/212 |
| 5,570,548 | A | | 11/1996 | Hopper | 52/204.5 |
| 5,572,840 | A | | 11/1996 | Fast et al. | 52/213 |
| 5,577,355 | A | | 11/1996 | Leonelli | 52/204.62 |
| 5,625,992 | A | | 5/1997 | Strick et al. | 52/656.9 |
| 5,660,010 | A | * | 8/1997 | Sayers | 52/211 |
| 5,669,192 | A | | 9/1997 | Opdyke et al. | 52/211 |
| 5,758,458 | A | * | 6/1998 | Ridge | 52/211 |
| 5,779,384 | A | | 7/1998 | Olsen | 403/231 |
| 5,857,299 | A | | 1/1999 | Gyllenberg et al. | 52/217 |
| 6,055,782 | A | * | 5/2000 | Morton et al. | 52/204.1 |
| 6,243,999 | B1 | * | 6/2001 | Silverman | 52/656.5 |

* cited by examiner

*Primary Examiner*—Michael Safavi
(74) *Attorney, Agent, or Firm*—Hayes Soloway

(57) ABSTRACT

A window or door casing includes two side sections, a header or top section and bottom section. The bottom section also has caps attached at either end. The trim casing is mountable on a window or door frame and is securely fastened to the side of the house ensuring a tight fit and finished appearance.

19 Claims, 13 Drawing Sheets

WINDOW AND DOOR CASING

This application is a divisional application of U.S. application Ser. No. 09/575,340 filed May 19, 2000 now abandoned.

BACKGROUND OF THE INVENTION

The use of vinyl siding in place of wood, aluminum or other materials on the exterior of a house in new construction as well as remodeling has become quite prevalent. Such siding has historically been made of aluminum or wood. Window and door openings in the exterior wall of a house are generally trimmed with wood casings or moldings framing the window and providing an aesthetically finished exterior look. One version of such a window trim has been the "Eastern" casing. Typically, the window manufacturer attaches a 3–4" wide board that is ¾ to 5/4" thick to the face of the window jamb and ships the window with this feature applied. Alternatively, the builder constructs the wood casing at the site. The house siding, whether wood or vinyl, is fitted to or butted up against the trim casing. In the case of vinyl siding, a "J" channel is nailed to the wall board and the vinyl siding slides behind the face of the J channel. One problem with this, however, is that the wooden casings are not compatible with aluminum or vinyl siding. For example, the wood requires continued painting, defeating the maintenance-free advantages of vinyl siding, the appearance will be inconsistent, and wood against vinyl creates the potential for unsightly gaps because of their different thermal characteristics.

With the introduction of the vinyl window an Eastern casing trim option had not been available in an extruded vinyl add-on. Accordingly, builders desiring the aesthetics of an Eastern casing, were relegated to using wood and/or wood wrapped in aluminum cladding requiring custom fitting, a labor intensive and expensive process.

BRIEF DESCRIPTION OF THE PRIOR ART

U.S. Pat. No. 4,193,238 describes a window casing cover comprised of trim molding members that snap onto a plurality of separate brackets that are individually attached to the original casing. Although the covers provides a maintenance free surface, the numerous components involved and the "do it yourself" appearance of the add-on side portions and coverings do not offer the structure and strength or appearance of an integrated component, nor is the problem of differing thermal expansion/contraction resolved.

U.S. Pat. No. 4,389,824 discloses window trim comprised of upper and side panels and a window sill covering. Each panel has a receiving strip which is fitted around the inside of the window casing and a substantially flat panel is bent at the site into an L-shaped configuration which is then fitted around the casing and overlies the siding. The receiving strip includes a spring held receiving slot for the L-shaped panel. U.S. Pat. No. 5,022,204 discloses a similar receiving strip and L-shaped facing strip in which the receiving strip may be attached to the front of the casing. Both of these approaches are time consuming to fabricate and install, are comprised of many components having different angles and fittings, and include the cumbersome method of using L-hooks screwed into the house to hold and align the strips.

A do-it-yourself kit of prefabricated components for retrofitting cladding over an existing door or window frame is disclosed in U.S. Pat. No. 5,669,192. The kit comprises sections for covering the side and the header surfaces of the existing trim. A lengthwise lip folds inward along one edge of each section and a lengthwise flange portion folds inward around the opposite edge of each such section, gripping the trim in frictional engagement. A J-strip exists around the frame, to retain the siding, the folded flange fitting between the J-strip and the siding. A drawback of this approach is that the use of friction to hold the cladding in place lacks stability and durability and will result in an inconsistent fit and appearance over time.

SUMMARY OF THE INVENTION

It is therefore an object of this invention to provide a window and door casing for use with new construction as well as remodeling that is simple to fit and install, will provide a durable, secure and complete aesthetic finished look, and will not be subject to differing thermal characteristics. The trim casing is comprised of extruded portions or sections with an integral "J" channel built in providing superior aesthetic features; two side sections, a header or top section and, in the case of a window application a sill bottom section. The sill also has caps attached at either end. The trim casing is mountable on a window or door frame and is securely fastened to the side of the house ensuring a tight fit.

In the preferred embodiment, the casing is comprised of extruded vinyl, and comprises pre-mitered side sections and the header section include a rapid fastening system incorporating a screw boss in the extrusion coupled with a tongue-in-groove design on the inside edge which is received by an accessory groove (channel) with a flexing accessory lock incorporated on the sides of the window or door frame, and a nailing fin on the opposite side, and in the case of a window, an extruded attachable sill nosing which simulates the thick wood look having insertable end caps to cover the open ends and an integral flange to cover the meeting point of the side casing to the sill nosing.

A method of installing the casing consistent with the invention includes the steps of: in the case of new construction, first installing, leveling and squaring the window or door properly; securing the window or door by nails, staples or screws using the window's or door's nailing fin; pre-assembling the top section of the pre-mitered casing to the side casings, mating the angled ends thereof and then screwing the sections together; sliding the resulting three-sided "horseshoe" shaped assembly over the front of the window or door, the tongues of the assembly fitting into the accessory grooves located on the window or door frame. Then placing the tongue or flange of the sill section into the accessory groove on the bottom end of the window and snapping it onto place and/or tapping the assembly with a mallet to secure a snug fit, with the side sections also fitting behind flange at the meeting point of the side sections to the sill section and the end caps are fitted into the sides of the sill section. The sill section is then fastened to the side sections with screws and the casing is secured to the side of the house with nails using the attached nailing fins.

These and other objects, features and advantages of the present invention will be better understood with reference to the detailed description of the preferred embodiment and the accompanying drawings.

DESCRIPTION OF THE PREFERRED EMBODIMENT

Figure 1:
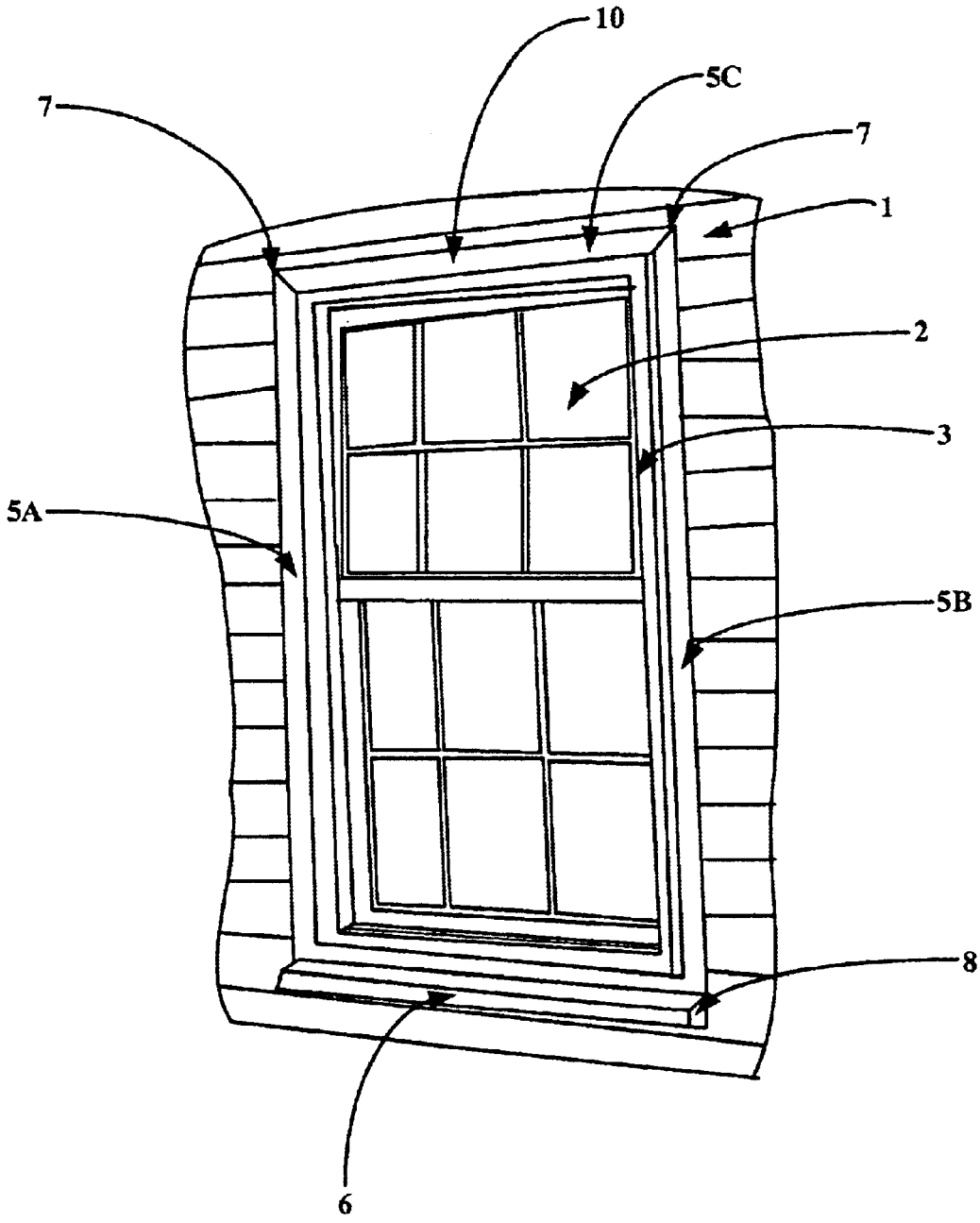
FIG. 1 is a perspective view of a window of a house and including the casing according to the present invention.
Figure 2:
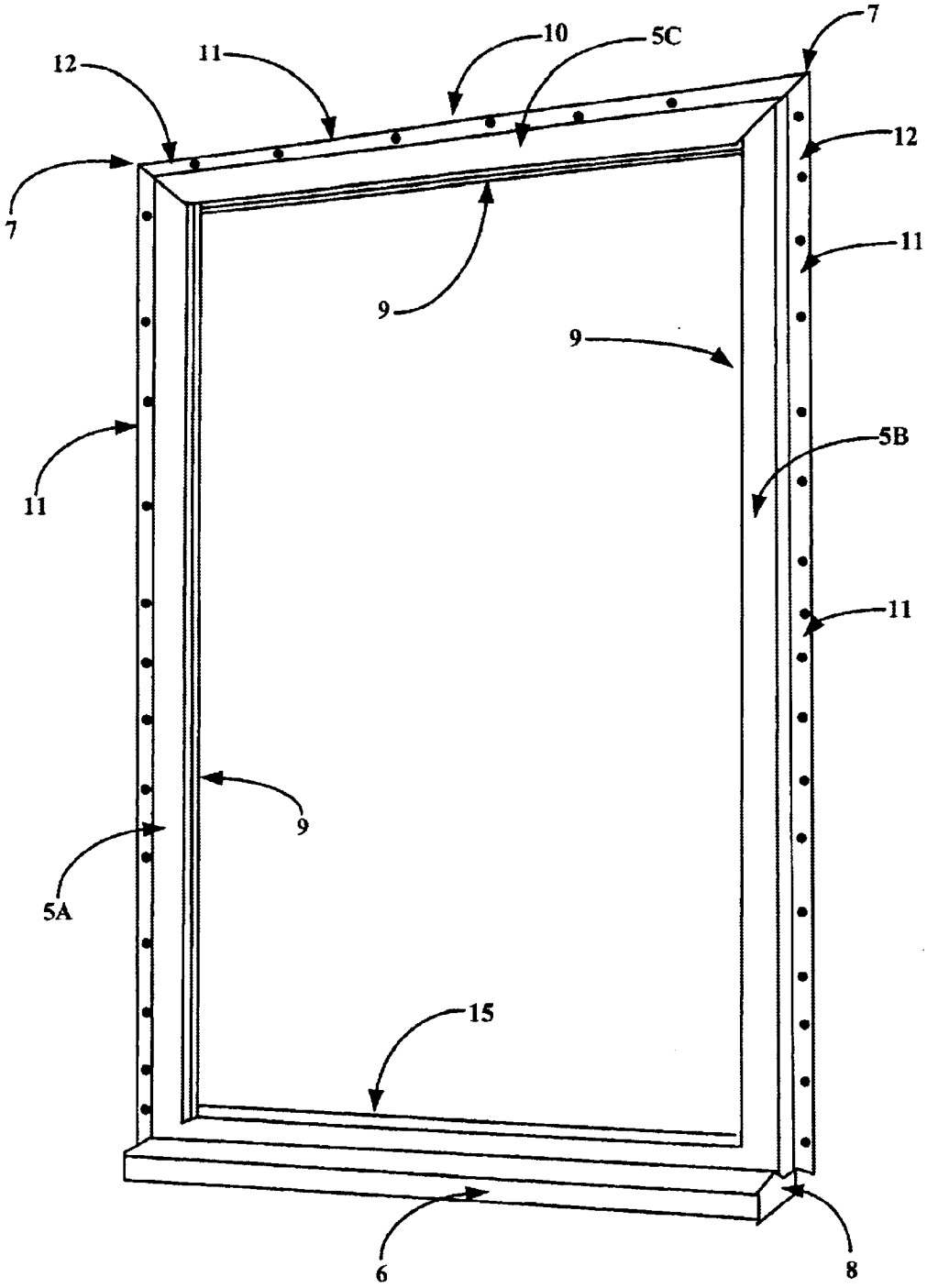
FIG. 2 is a perspective view of the assembled casing according to the invention.

Referring to FIG. 1 is shown a preferred embodiment of an eastern casing 10 mounted on the window frame 3 of a window 2 installed on a house. In FIG. 2 the assembled casing 10 is shown independent of the window or house. In the preferred embodiment casing 10 is comprised of two side sections 5*a* and 5*b*, header or top section 5*c* and sill or bottom section 6 with end caps 8 attached at either end of the sill. The sections of the casing may be pre-cut for standard sized windows or may be custom cut in advance or at the site, for non-standard sized windows. Preferably, the casing 10 is comprised of extruded vinyl, although other materials such as aluminum, may be used. The top corners of side sections 5*a* and 5*b* are pre-mitered at 45° angles and meet flush with the ends of the top section 5*c* which are also pre-mitered at 45° angles at corners 7. It is appreciated that the mitered angles of the top and side sections may vary from 0–90° depending upon the aesthetic look desired or to combine with decorative caps or millwork, for example. It should also be understood that the same type of casing, with the exception of the sill, may be used in trimming a door or other opening.

Figure 5B:
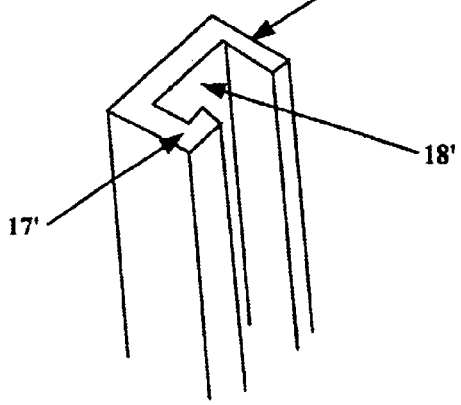
FIG. 5*b* is a fragmentary perspective view of an add-on accessory groove device.
Figure 5:
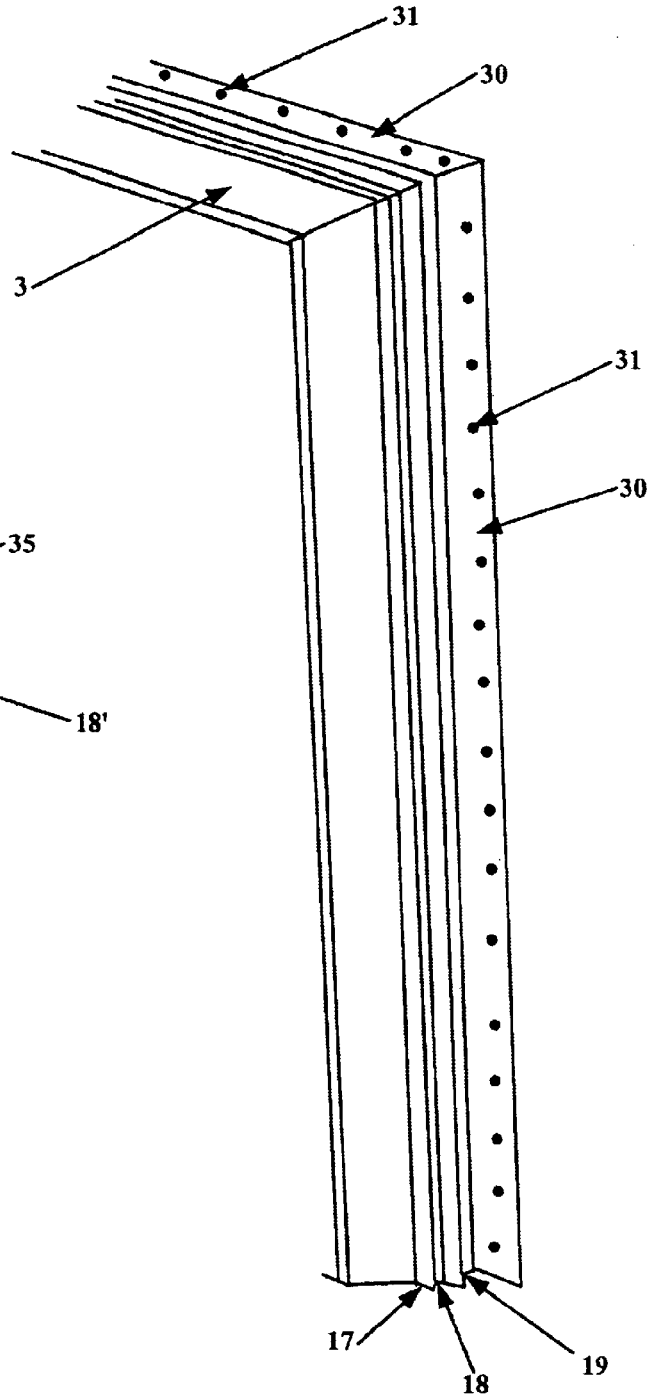
FIG. 5 is a perspective of two sides of a window frame according to the present invention.
Figure 8A:
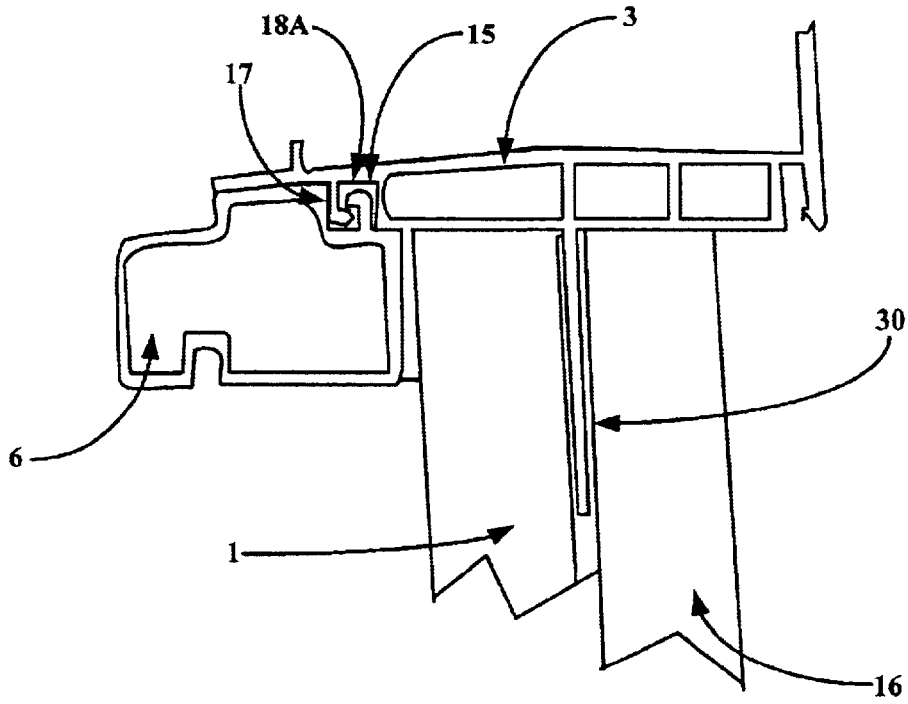
FIG. 8*a* is a side view of a sill mounted on the bottom of a window frame installed on a house showing the exterior siding.
Figure 8B:
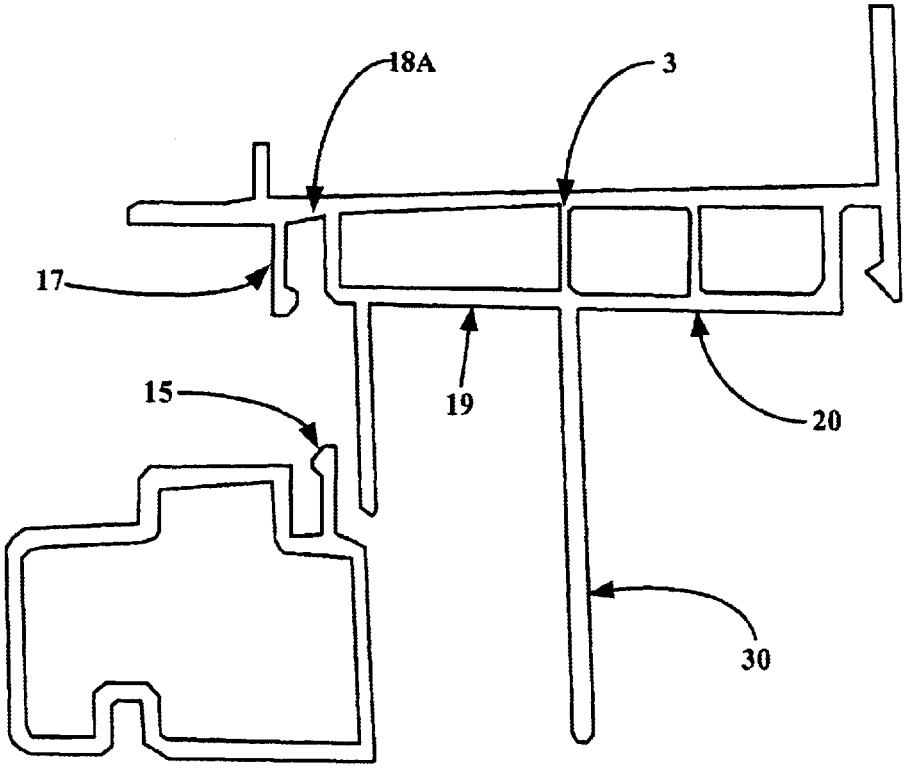
FIG. 8*b* is an exploded side view of a sill and the bottom of a window frame.
Figure 9:
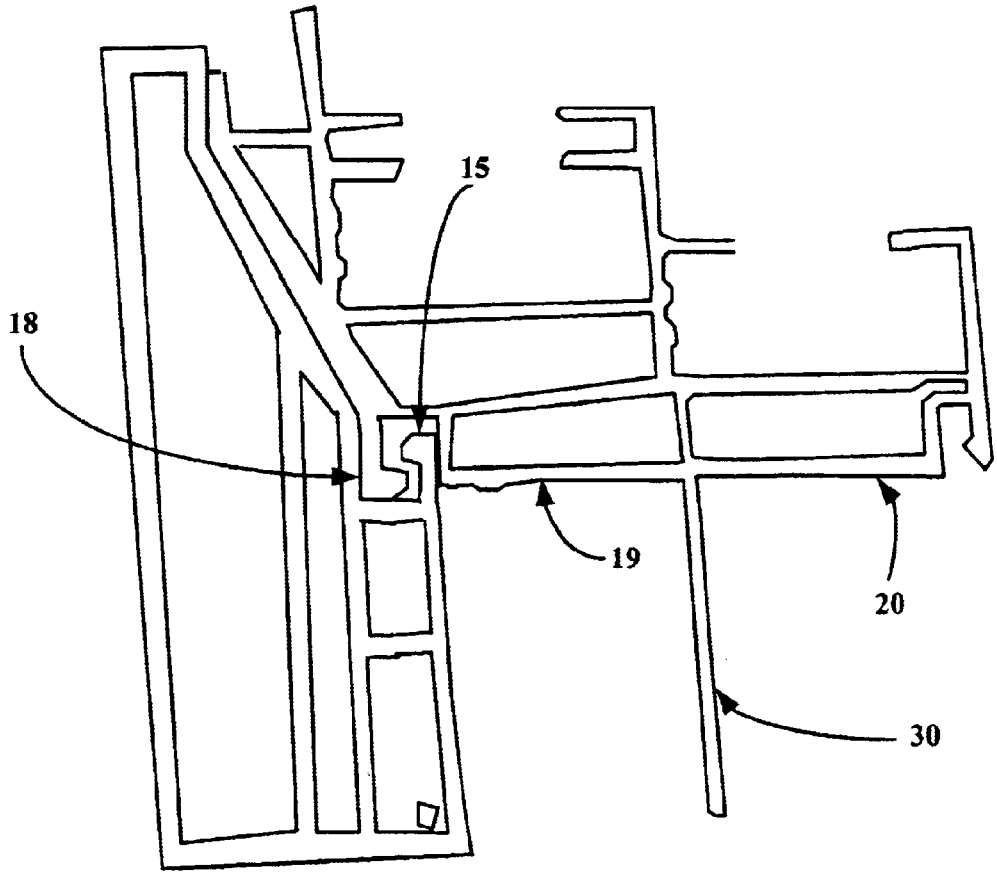
FIG. 9 is a top elevational view of a sill mounted on the bottom of a window frame according to the invention.
Figure 10A:
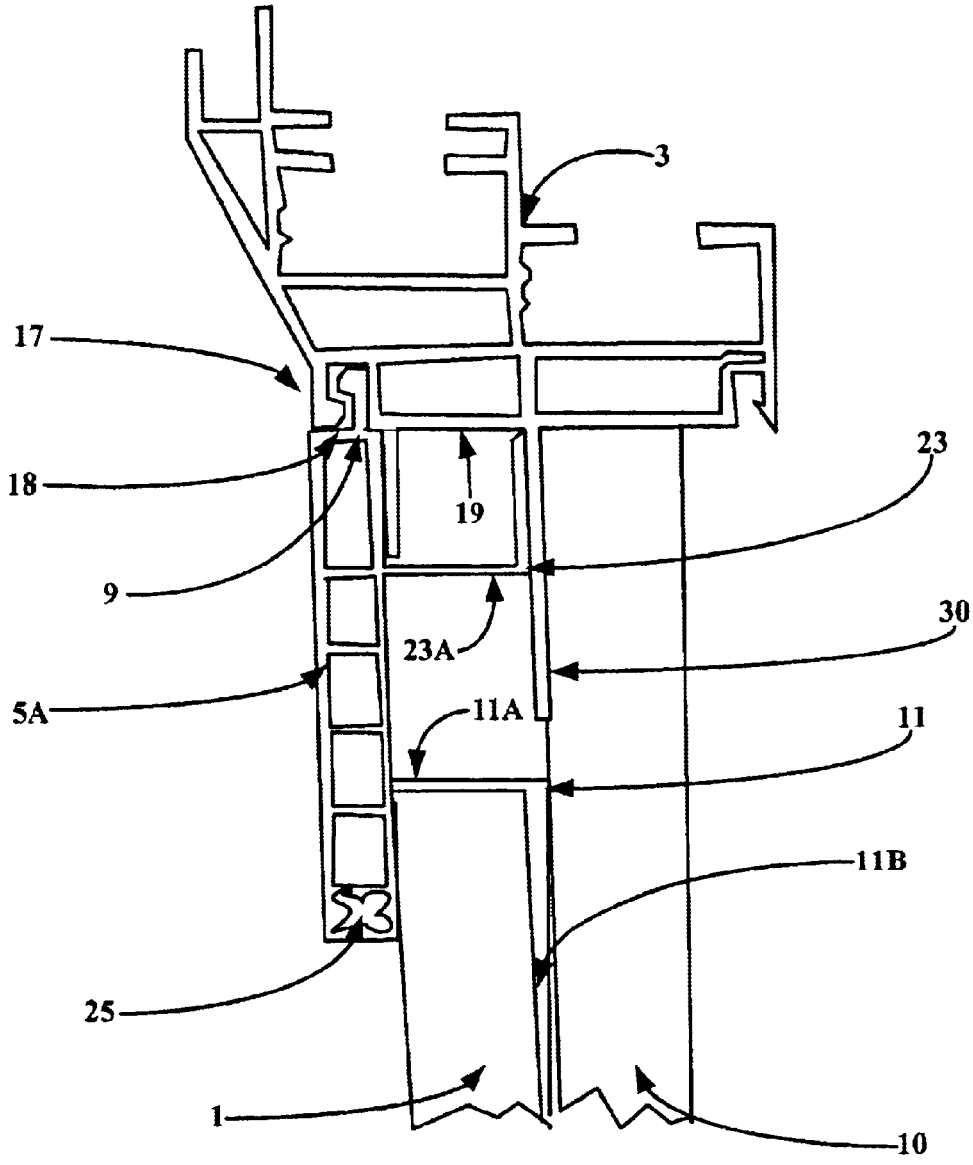
FIG. 10*a* is a top plan view of a side casing section mounted on the side of the window frame installed on a house showing the exterior siding.
Figure 10B:
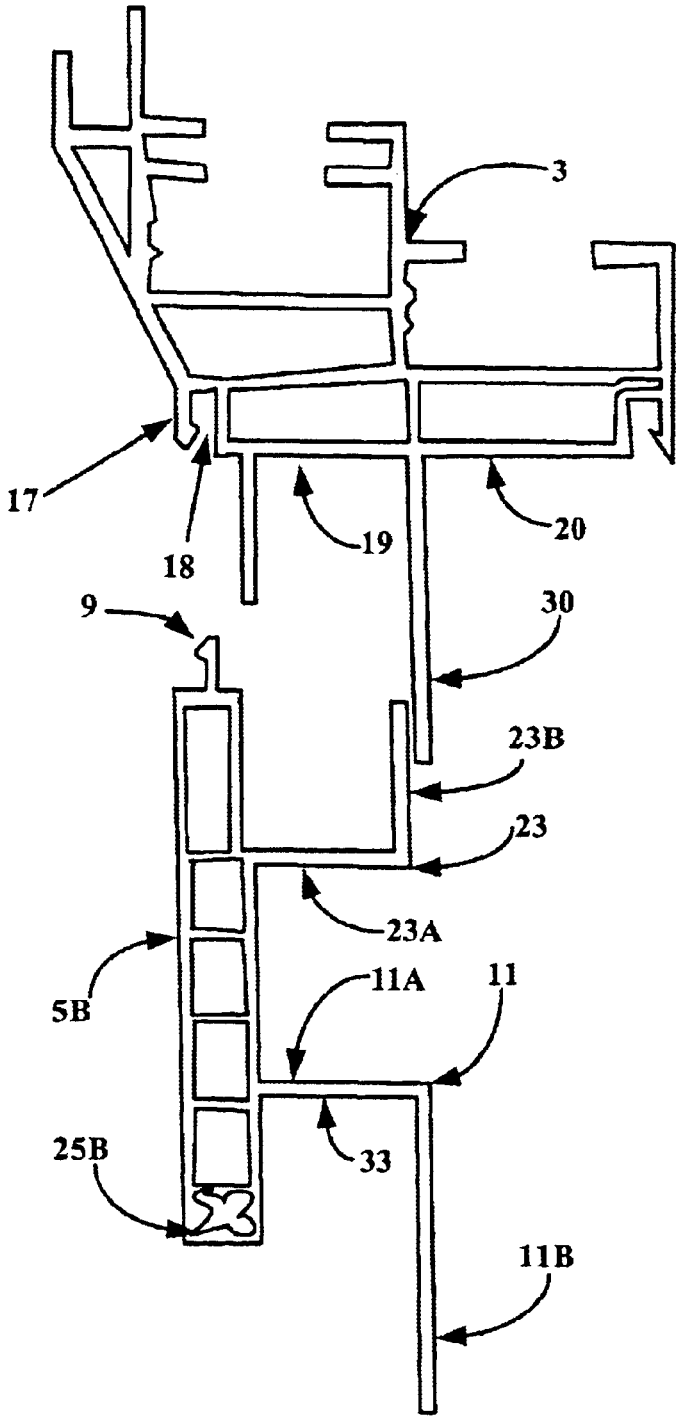
FIG. 10*b* is an exploded top view of a side casing section and the side of the window frame.

Referring now again to FIG. 2, nailing fins 11 are located on the outside edges of the side and top sections 5*a*, 5*b* and 5*c*. When the casing 10 has been mounted on the window, nailing fins 11 sit flush against the sheathing or other underlayer of the house and nails are driven through the plurality of slotted nail holes 12 extending the length of the nailing fins to further secure the casing to the house. Along the length of the inside edges of top and sides casings 5*a*, 5*b* and 5*c* are located tongues 9 to be received by accessory grooves or channels 18 inside the window frame 3 as shown in FIGS. 5, 10*a* and 10*b*. Along the inside edge of sill 6 is located a sill tongue 15 which is received by the accessory groove or channel 18*a* in the bottom of the window frame 3 as shown in FIGS. 8*a*, 8*b* and 9. Preferably, sill tongue 15 has a notch or flange at its upper end to overlap a flexible locking accessory 17 in accessory groove 18*a* in the bottom of the window frame. End caps 8 are attached to sill 6 to complete the finished look.

Figure 3:
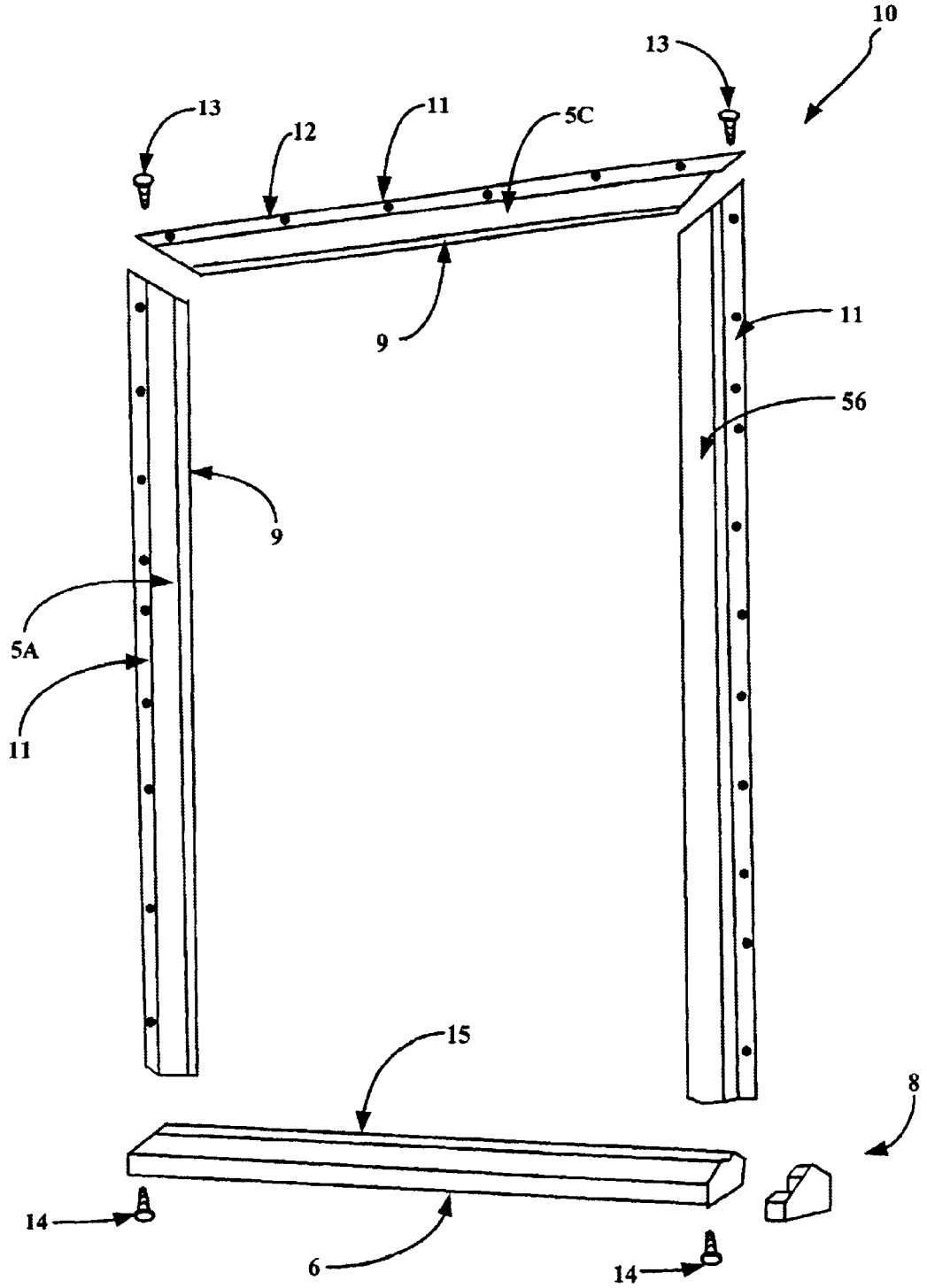
FIG. 3 is perspective exploded view of the casing of FIG. 2.
Figure 4A:
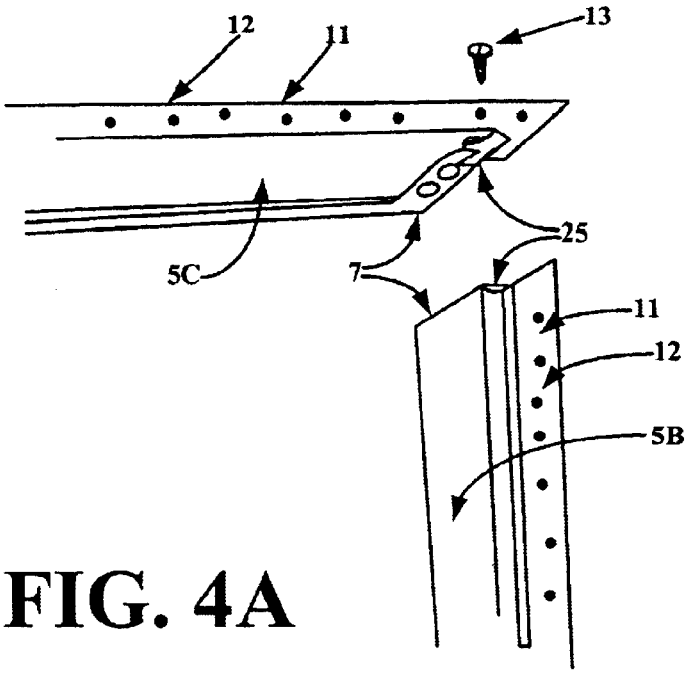
FIG. 4*a* is a fragmentary perspective view of the upper right corner of the casing of FIG. 3.

As seen in FIGS. 3, 4*a*, 4*b* and 4*c*, a complete window casing 10 is comprised of few components and is easily assembled and mounted on the window frame. In the preferred embodiment, after first installing the window and window frame 3 in the house in known fashion, nails or screws are driven through the nail slots 31 in the window nailing fin 30 as shown in FIG. 5 into the sheathing 16, to secure the installed window. Then, as shown in FIGS. 3 and 4*a*, the pre-mitered ends 7 of side sections 5*a* and 5*b* are placed adjacent to the pre-mitered ends 7 of top casing section 5*c* and attached by screws 13 inserted in the top casing, preferably through predrilled holes, into receiving screw bosses 25 located in the side casings, creating a three-sided "horseshoe" shaped assembly. The horseshoe shaped assembly is then slidably mounted over the window frame 3, tongues 9 on the inside edges of the side sections 5*a* and 5*b* being first inserted in the accessory grooves 18 of the sides of the window frame 3 as shown in FIGS. 5, 10*a* and 10*b*, then tongue-in-groove, sliding the three-sided assembly down over the front of the window frame, the tongues 9 of the side casing sections assembly fitting into the accessory grooves 18 located on the sides of the window frame 3 until the tongue 9 of the top casing section 5*c* mates with and is seated in the accessory groove 18 of the top of the window frame.

Referring to FIGS. 10*a* and 10*b*, in a preferred embodiment, nailing fin 11 of the side and top casings 5*a*, 5*b* and 5*c* is in the form of an L-shaped flange, portion 11*a* of the flange extends generally perpendicular from the back of the casing approximately ¾" and the other portion 11*b* of L-shaped nailing fin 11 extends in a direction away from the window frame 3 generally parallel with exterior face of the casing so that potion 11*b* of nailing fin lilies essentially flush with the underlayer or sheathing 16 of the house. Portion 23*a* of second L-shaped flange 23, extends generally perpendicular from the back of the casing approximately ¾" and the other portion 23*b* of said L-shaped flange 23 extends in a direction toward window frame 3 generally parallel with exterior face of the easing so that portion 23*b* of L-shaped flange lies in slot 19 essentially flush with the nailing fin 30 of the window frame providing further support for the easing on the window frame.

Figure 4B:
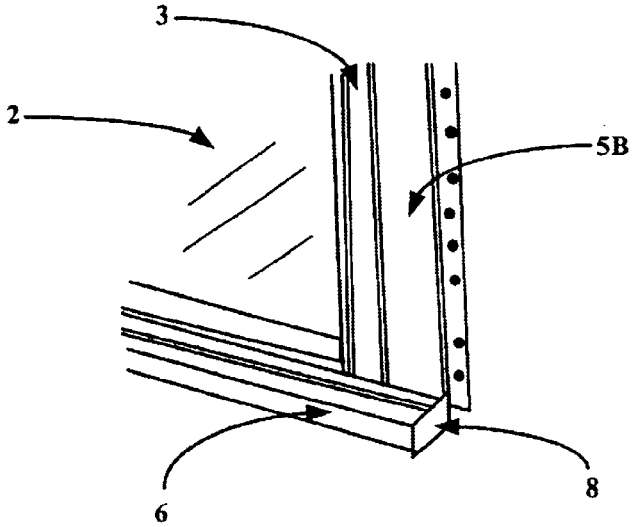
FIG. 4*b* is a perspective view of the lower right corner of the casing of FIG. 2.
Figure 4C:
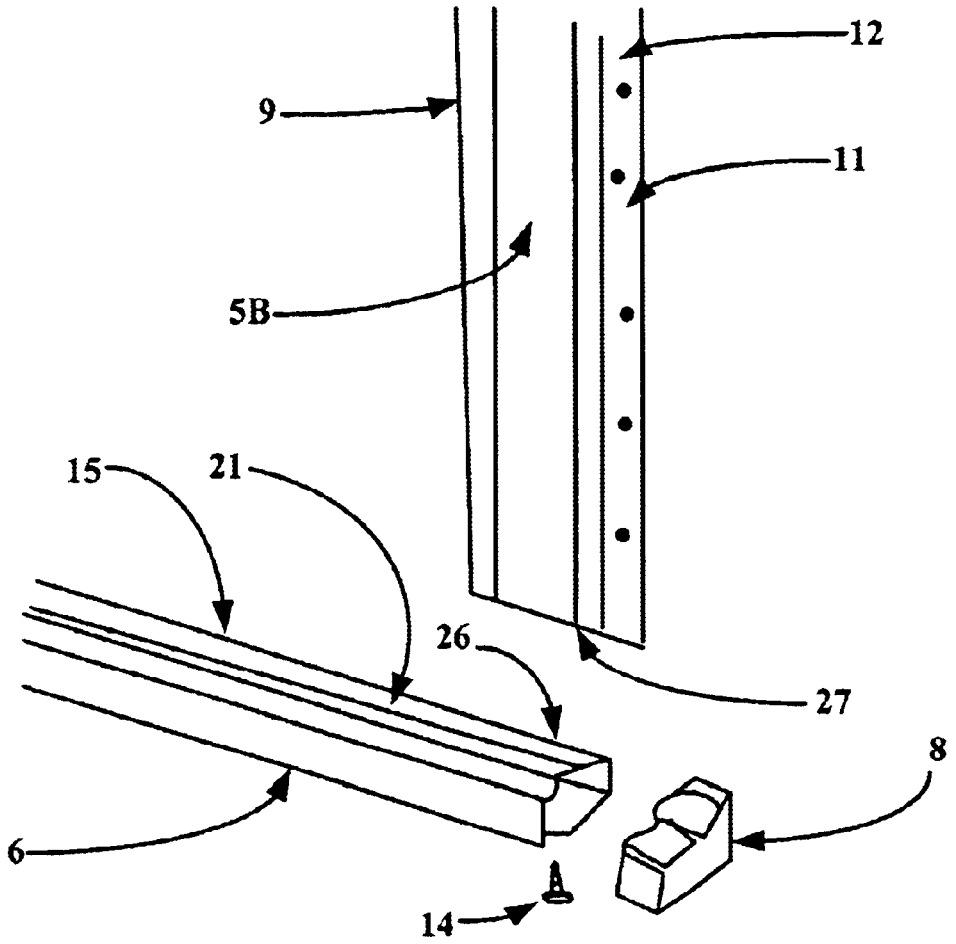
FIG. 4*c* is a fragmentary exploded perspective view of the lower right corner of the casing of FIG. 3.

Once the three-sided assembly is in place, preferably, at least one nail or screw will be driven through nail slots 12 in each of the nailing fins 11 to hold the three-sided assembly in place on the window frame. As shown in FIGS. 3, 4*b*, 4*c*, 8*a*, 8*b* and 9, sill 6 is then raised upwards toward the bottom of the window frame 3 inserting sill tongue 15 into the accessory groove 18 on the bottom of the window frame 3 and snapping it onto place. Preferably, sill tongue 15 is notched or flanged and lockingly engages flexible accessory lock 17 on the window frame. As shown in FIGS. 4*b* and 4*c*, the bottoms 27 of the side casings 5*a* and 5*b* seat flat on sill 6 at meeting places 26, behind the step 21 of the sill, which may be tapped into place with a mallet, if necessary. End caps 8 are fitted into the sides of the sill section 6. The sill 6 is then secured to the side casings 5*a* and 5*b* with screws 14 inserted in the sill and received in screw bosses 25 located in the side casings. Preferably the sill 6 should have pre-drilled holes 32 to accommodate screws 14. The completed casing 10 is then secured to the side of the house with nails, screws or staples being driven through nail holes 12 in nailing fins 11. Thereafter, siding 1 is then installed on the house in known fashion, the portion of the siding that lies adjacent to the window frame and casing being cut to fit snugly between the casing J-channel in recess 33 formed by the back of the casing and L-shaped section 11.

Referring to FIG. 5 is shown a portion of the top and sides sections window frame 3, nailing fin 30 and nail slots 31 for securing the window frame to the house and accessory groove 18 for receiving tongue 9 of the window casing and flexible accessory lock 17 to lockingly engage the tongue 9. Sill tongue 15 of sill 6 is similarly received in accessory groove 18 of the bottom section of the casing. It will be understood that not all window frames will have accessory groves. This particularly will be the case in older construction where the original windows and window frames are not being replaced. In order to use the casing system of the present invention with these older style windows, a prefabricated structure having an accessory groove can be installed around the periphery of the window frame to accommodate the casing. Such a device 35 as shown in FIG. 5*b*, is essentially a C-shaped member and includes accessory groove 18 and J-channel 17 and may be made of materials such as extruded vinyl or aluminum, for example. Device 35 may be affixed to the window frame in a conventional manner, such as by use of nails, screws or staples.

Figure 6:
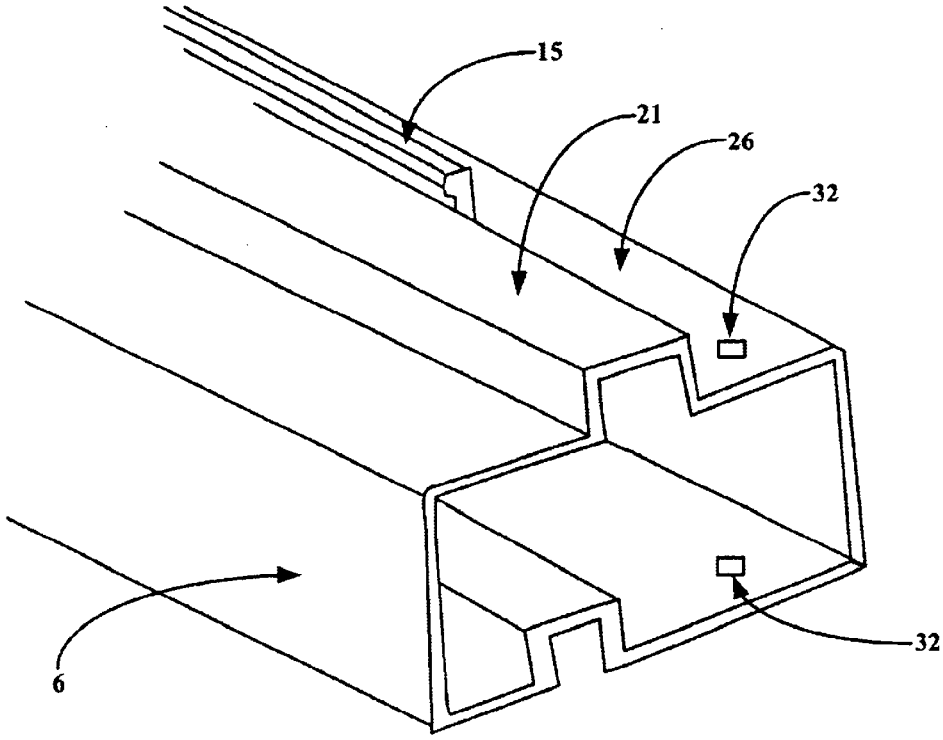
FIG. 6 is a fragmentary perspective view of a sill of the casing according to the invention.
Figure 7:
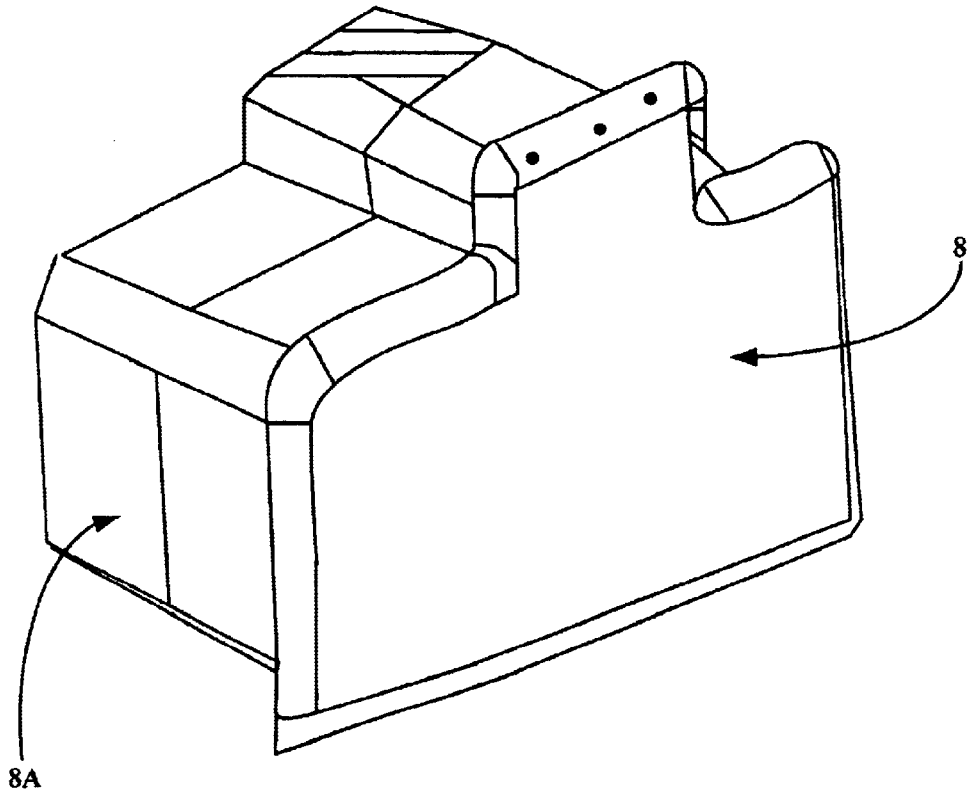
FIG. 7 is a fragmentary perspective view of an end cap of a sill of the casing according to the invention.

One side of sill 6 and end cap 8 are shown in greater detail in FIGS. 6 and 7. The sill 6 includes sill tongue 15 which is inserted in accessory groove 18 of the bottom section of the window frame 3. In the preferred embodiment, sill tongue 15 has a notch or flange at one end which lockingly engages a J-channel 17 in the said accessory groove. As can be seen in FIG. 6, sill tongue 15 is recessed inwardly from the side of sill 6 to enable the bottom 27 of the side casing sections 5*a*, 5*b* to seat flat on sill 6 at meeting place 26, behind the step 21 extending upward from the sill. Preferably, the meeting place 26 is approximately the width of the side casing sections 5*a*, 5*b* which are maintained in place between the rear side of the step 21 and the exterior of the siding 1 of the house. The end caps 8 may be made of the same material as the sill and are sized and configured to fit securely in the opposite sides of the sill section 6. As is also shown in FIGS. 3, 4*b* and 4*c*, screws 14 are then inserted through pre-drilled holes 32 in the sill and pre-drilled holes 33 in the end caps and received in screw bosses 25 in the side casings 5*a* and 5*b*.

In addition to utilizing the casing as described in connection with windows, the casing of the present invention may be used in connection with doors, passageways, or any other type of opening in a structure. Further, the casing system of the present invention is not limited to four-sided openings, and may be utilized in archways calling for a curved trim, a one-piece ornamental header, a multi-sided window or other structure, and may be prefabricated or cut at the site.

Although described in terms of the presently preferred embodiment, those skilled in the art will appreciate that the present invention is not limited to the embodiment described.

What is claimed is:

1. A window casing kit for a window frame, comprising:

a plurality of elongated panels mountable about the perimeter of a window frame on at least three sides, said panels having a front portion having a planar front surface extending from a first edge to a second edge, a rear portion having a rear surface, at least one rib coupling the front portion to the rear portion, at least one screw boss disposed between the front portion and the rear portion for securing adjacent panels together, a tongue disposed in close proximity to the first edge, the tongue sized to engage a groove on the window frame, and a first "L" shaped flange, a first portion of the first "L" shaped flange extending from the rear surface a spaced distance from the second edge and a second portion of the first "L" shaped flange extending generally parallel to the front surface away from the first edge, the first portion of the first "L" shaped flange, the second portion of the first "L" shaped flange, the rear surface of the panel forming a channel sized to accept siding, and a second "L" shaped flange, a first portion of the second "L" shaped flange extending from the rear surface a spaced distance from the second edge and a second portion of the second "L" shaped flange extending generally parallel to the front surface towards the first edge.

2. The window casing kit of claim 1, wherein the tongue extends from a side portion coupled to the front portion, the tongue extending parallel to the front surface.

3. The window casing kit of claim 1, wherein at least one end of each elongated panel is mitered.

4. The window casing kit of claim 1, wherein the elongated panels are extruded.

5. The window casing kit of claim 4, wherein the elongated panels are extruded vinyl.

6. The window casing kit of claim 1, further comprising a sill nose, the sill nose having a tongue sized to be received by an accessory groove along a bottom of the window frame.

7. The window casing of claim 6, wherein the tongue has a notch at one end that overlaps a locking accessory in the accessory groove along the bottom of the window frame.

8. A window casing kit for a window frame, comprising:

a plurality of elongated panels mountable about the perimeter of a window frame on at least three sides, said panels having a front portion having a planar front surface extending from a first edge to a second edge, a rear portion having a rear surface, at least one rib coupling the front portion to the rear portion, at least one screw boss disposed between the front portion and the rear portion for securing adjacent panels together, a tongue disposed in close proximity to the first edge, the tongue sized to engage a groove on the window frame, and a first "L" shaped flange, a first portion of the first "L" shaped flange extending from the rear surface a spaced distance from the second edge and a second portion of the first "L" shaped flange extending generally parallel to the front surface away from the first edge, the first portion of the first "L" shaped flange, the second portion of the first "L" shaped flange, the rear surface of the panel forming a channel sized to accept siding, and a second "L" shaped flange, a first portion of the second "L" shaped flange extending from the rear surface a spaced distance from the second edge and a second portion of the second "L" shaved flange extending generally parallel to the front surface towards the first edge, wherein the distance from the second portion of the second "L" shaped flange to the front surface is less than the distance from the second portion of the first "L" shaped flange to the front surface.

9. A window casing kit for a window frame, comprising:

a plurality of elongated panels mountable about the perimeter of a window frame on at least three sides, said panels having a front portion having a planar front surface extending from a first edge to a second edge, a rear portion having a rear surface, at least one rib coupling the front portion to the rear portion, at least one screw boss disposed between the front portion and the rear portion for securing adjacent panels together, a tongue disposed in close proximity to the first edge, the tongue sized to engage a groove on the window frame, and a first "L" shaped flange, a first portion of the first "L" shaved flange extending from the rear surface a spaced distance from the second edge and a second portion of the first "L" shaped flange extending generally parallel to the front surface away from the first edge, the first portion of the first "L" shaped flange, the second portion of the first "L" shaped flange, and the rear surface of the panel forming a channel sized to accept siding, wherein the second portion of the first "L" shaped flange has a plurality of spaced nail slots.

10. A window assembly, comprising:

a sash;

a frame surrounding the sash on at least three sides, the frame having a perimeter groove; and a trim kit comprising a plurality of coupled elongated panels mountable about the perimeter of the window frame on at least three sides, said panels having a front portion having a planar front surface extending from a first edge to a second edge, a rear portion having a rear surface, at least one rib coupling the front portion to the rear portion, a tongue disposed in close proximity to the first edge, the tongue sized to engage the perimeter groove on the window frame, and a first "L" shaped flange, a first portion of the first "L" shaped flange extending from the rear surface a spaced distance from the second edge and a second portion of the first "L" shaped flange extending generally parallel to the front surface away from the window frame, the first portion of the "L" shaped flange, the second portion of the first "L" shaped flange, and the rear surface of the panel forming a channel sized to accept siding, wherein the elongated panels further comprising a second "L" shaped flange, a first portion of the second "L" shaped flange extending from the rear surface a spaced distance from the second edge and a second portion of the second "L" shaped flange extending generally parallel to the front surface towards the first edge.

11. The window assembly of claim 10, wherein the tongue extends from a side portion coupled to the front portion, the tongue extending parallel to the front surface.

12. The window assembly of claim 10, wherein the elongated panels are extruded vinyl.

13. The window assembly of claim 10, wherein the elongated panels are fused together at mitered ends.

14. A window assembly, comprising:

a sash;

a frame surrounding the sash on at least three sides, the frame having a perimeter groove; and a trim kit comprising a plurality of coupled elongated panels mountable about the perimeter of the window frame on at least three sides, said panels having a front portion having a planar front surface extending from a first edge to a second edge, a rear portion having a rear surface, at least one rib coupling the front portion to the rear portion, a tongue disposed in close proximity to the first edge, the tongue sized to engage the perimeter groove on the window frame, and a first "L" shaped flange, a first portion of the first "L" shaped flange extending from the rear surface a spaced distance from the second edge and a second portion of the first "L" shaped flange extending generally parallel to the front surface away from the window frame, the first portion of the "L" shaped flange, the second portion of the first "L" shaped flange, and the rear surface of the panel forming a channel sized to accept siding, wherein the second portion of the first "L" shaped flange has a plurality of spaced nail slots.

15. A window or door casing, comprising:

a front portion having a planar front surface extending from a first edge to a second edge;

a rear portion having a rear surface;

at least one rib coupling the front portion to the rear portion;

a tongue disposed in close proximity to the first edge;

a first "L" shaped nail flange, a first portion of the "L" shaped nail flange extending from the rear surface a spaced distance from the second edge and a second portion of the "L" shaped nail flange extending generally parallel to the front surface away from the first edge, the first portion of the first "L" shaped nail flange, the second portion of the first "L" shaped nail flange, and the rear surface forming a channel sized to accept siding; and a second "L" shaped flange, a first portion of the second "L" shaped flange extending from the rear surface a spaced distance from the second edge and a second portion of the second "L" shaped flange extending generally parallel to the front surface towards the first edge.

16. The window or door casing of claim 15, wherein the tongue extends from a side portion coupled to the front portion and extends parallel to the front surface.

17. The window or door casing of claim 15, further comprising at least one screw boss disposed between the front portion and the rear portion.

18. A window assembly, comprising:

a sash;

a frame surrounding the sash on at least three sides, the frame having a perimeter groove;

a trim kit comprising a plurality of coupled elongated panels mountable about the perimeter of the window frame on at least three sides, said panels having a front portion having a planar front surface extending from a first edge to a second edge, a rear portion having a rear surface, at least one rib coupling the front portion to the rear portion, a tongue disposed in close proximity to the first edge, the tongue sized to engage the perimeter groove on the window frame, and a first "L" shaped flange, a first portion of the first "L" shaped flange extending from the rear surface a spaced distance from the second edge and a second portion of the first "L" shaped flange extending generally parallel to the front surface away from the window frame, the first portion of the "L" shaped flange, the second portion of the first "L" shared flange, and the rear surface of the panel forming a channel sized to accept siding; and a sill nose, the sill nose having a tongue sized to be received by an accessory groove along a bottom of the frame.

19. A window assembly, comprising:

a sash;

a frame surrounding the sash on at least three sides, the frame having a perimeter groove;

a trim kit comprising a plurality of coupled elongated panels mountable about the perimeter of the window frame on at least three sides, said panels having a front portion having a planar front surface extending from a first edge to a second edge, a rear portion having a rear surface, at least one rib coupling the front portion to the rear portion, a tongue disposed in close proximity to the first edge, the tongue sized to engage the perimeter groove on the window frame, and a first "L" shaped flange, a first portion of the first "L" shaped flange extending from the rear surface a spaced distance from the second edge and a second portion of the first "L" shaped flange extending generally parallel to the front surface away from the window frame, the first portion of the "L" shaped flange, the second portion of the first "L" shaped flange, and the rear surface of the panel forming a channel sized to accept siding; and a sill nose, the sill nose having a tongue sized to be received by an accessory groove along a bottom of the frame, wherein the tongue has a notch at one end that overlaps a locking accessory in the accessory groove along the bottom of the frame.

* * * * *

UNITED STATES PATENT AND TRADEMARK OFFICE

CERTIFICATE OF CORRECTION

PATENT NO. : 6,857,232 B2
DATED : February 22, 2005
INVENTOR(S) : Bealko

It is certified that error appears in the above-identified patent and that said Letters Patent is hereby corrected as shown below:

Column 6,
Line 28, after "casing" insert -- kit --.
Line 53, "shaved" should be -- shaped --.

Column 7,
Line 5, "shaved" should be -- shaped --.

Column 8,
Line 52, "shared" should be -- shaped --.

Signed and Sealed this

Seventh Day of June, 2005

JON W. DUDAS
*Director of the United States Patent and Trademark Office*

US006857232C1

(12) EX PARTE REEXAMINATION CERTIFICATE (6990th)

United States Patent
Bealko

(10) Number: US 6,857,232 C1
(45) Certificate Issued: Aug. 11, 2009

(54) WINDOW AND DOOR CASING

(75) Inventor: Donald J. Bealko, Bedford, NH (US)

(73) Assignee: Riverside Millwork Co., Inc., Penacook, NH (US)

Reexamination Request:
No. 90/008,913, Nov. 5, 2007

Reexamination Certificate for:

| | |
|---|---|
| Patent No.: | **6,857,232** |
| Issued: | **Feb. 22, 2005** |
| Appl. No.: | **10/287,962** |
| Filed: | **Nov. 5, 2002** |

Certificate of Correction issued Jun. 7, 2005.

Related U.S. Application Data

(62) Division of application No. 09/575,340, filed on May 19, 2000, now abandoned.

(51) Int. Cl.
*E06B 1/04* (2006.01)

(52) U.S. Cl. ..... 52/211; 52/656.5
(58) Field of Classification Search ..... None
See application file for complete search history.

(56) References Cited

U.S. PATENT DOCUMENTS

| | | | | |
|---|---|---|---|---|
| 4,115,973 | A | | 9/1978 | Anderson |
| 4,328,644 | A | | 5/1982 | Scott et al. |
| 4,624,091 | A | | 11/1986 | Biro |
| 4,686,805 | A | | 8/1987 | Forslin |
| 4,821,472 | A | | 4/1989 | Tix |
| 5,090,168 | A | | 2/1992 | Fast et al. |
| 5,119,609 | A | | 6/1992 | Tait et al. |
| 5,555,684 | A | | 9/1996 | Galowitz et al. |
| 5,625,992 | A | | 5/1997 | Strick et al. |
| 5,651,222 | A | | 7/1997 | Bridges et al. |
| 5,660,010 | A | * | 8/1997 | Sayers ..... 52/217 |
| 6,044,611 | A | * | 4/2000 | Brunett ..... 52/656.5 |
| 6,055,782 | A | | 5/2000 | Morton et al. |
| 6,857,232 | B2 | | 2/2005 | Bealko |

* cited by examiner

*Primary Examiner*—Glenn K. Dawson

(57) ABSTRACT

A window or door casing includes two side sections, a header or top section and bottom section. The bottom section also has caps attached at either end. The trim casing is mountable on a window or door frame and is securely fastened to the side of the house ensuring a tight fit and finished appearance.

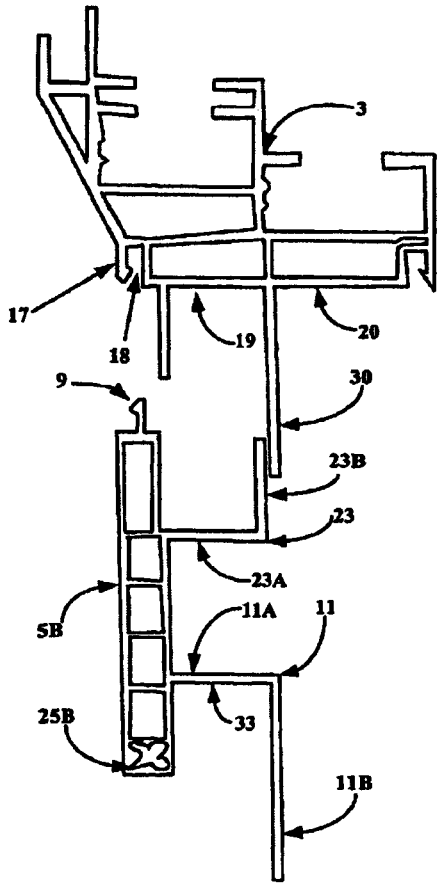

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 14, 18 and 19 is confirmed.

Claim 9 is cancelled.

Claims 1-8, 10-13 and 15-17 were not reexamined.

* * * * *